US009046093B2

(12) United States Patent
Kodama et al.

(10) Patent No.: US 9,046,093 B2
(45) Date of Patent: Jun. 2, 2015

(54) FLUID CONTROL DEVICE

(75) Inventors: Yukiharu Kodama, Nagaokakyo (JP); Atsuhiko Hirata, Nagaokakyo (JP); Takenobu Maeda, Nagaokakyo (JP); Kenta Omori, Nagaokakyo (JP); Yoshihiko Sano, Kyoto (JP)

(73) Assignees: Murata Manufacturing Co., Ltd., Kyoto (JP); Omron Healthcare Co., Ltd., Kyoto (JP)

( * ) Notice: Subject to any disclaimer, the term of this patent is extended or adjusted under 35 U.S.C. 154(b) by 374 days.

(21) Appl. No.: 13/603,724

(22) Filed: Sep. 5, 2012

(65) Prior Publication Data

US 2013/0058819 A1 Mar. 7, 2013

(30) Foreign Application Priority Data

Sep. 6, 2011 (JP) ..... 2011-194430

(51) Int. Cl.
*F04B 17/03* (2006.01)
*F04B 43/04* (2006.01)
*F04B 45/047* (2006.01)

(52) U.S. Cl.
CPC ..... *F04B 43/043* (2013.01); *F04B 45/047* (2013.01)

(58) Field of Classification Search
CPC ..... F04B 43/043; F04B 43/046
USPC ..... 417/413.2, 413.3; 92/91, 92
See application file for complete search history.

(56) References Cited

U.S. PATENT DOCUMENTS

| | | | | |
|---|---|---|---|---|
| 5,116,021 | A | 5/1992 | Faust et al. | |
| 7,025,324 | B1 * | 4/2006 | Slocum et al. | 251/11 |
| 2006/0232167 | A1 | 10/2006 | Jordan | |
| 2009/0148318 | A1 | 6/2009 | Kamitani et al. | |
| 2011/0070110 | A1 | 3/2011 | Hirata | |
| 2011/0076170 | A1 | 3/2011 | Fujisaki et al. | |

FOREIGN PATENT DOCUMENTS

| | | | |
|---|---|---|---|
| DE | 10 2009 013 913 | A1 | 9/2010 |
| JP | 02-308988 | A | 12/1990 |
| JP | 04-194380 | A | 7/1992 |
| JP | 10-299659 | A | 11/1998 |
| JP | 11-214764 | * | 8/1999 |
| JP | 2004-353638 | A | 12/2004 |
| JP | 2008-180161 | A | 8/2008 |
| WO | 92/16247 | A2 | 10/1992 |

(Continued)

OTHER PUBLICATIONS

Official Communication issued in corresponding Japanese Patent Application No. 2011-194430, mailed on Aug. 6, 2013.

(Continued)

*Primary Examiner* — Charles Freay
(74) *Attorney, Agent, or Firm* — Keating & Bennett, LLP

(57) ABSTRACT

A fluid control device includes a vibrating plate including a first main surface and a second main surface, a driver that is provided on the first main surface of the vibrating plate and vibrates the vibrating plate, and a plate that is provided on the second main surface of the vibrating plate and has a hole provided thereon. At least one of either the vibrating plate or the plate is positioned between the hole and a region of the vibrating plate facing the hole, and includes a projection projecting in a direction intermediate between the hole and the region of the vibrating plate facing the hole.

11 Claims, 17 Drawing Sheets

(56) References Cited

FOREIGN PATENT DOCUMENTS

| | | | |
|---|---|---|---|
| WO | 2008/069264 | A1 | 6/2008 |
| WO | 2009/145064 | A1 | 3/2009 |

OTHER PUBLICATIONS

Hirata et al., "Fluid Control Device," U.S. Appl. No. 13/603,689, filed Sep. 5, 2012.

Hirata et al., "Fluid Control Device," U.S. Appl. No. 13/603,701, filed Sep. 5, 2012.

Hirata et al., "Fluid Control Device," U.S. Appl. No. 13/603,713, filed Sep. 5, 2012.

Official Communication issued in corresponding European Patent Application No. 12183361.0, mailed on Dec. 5, 2012.

* cited by examiner

FLUID CONTROL DEVICE

CROSS REFERENCE

This non-provisional application claims priority under 35 U.S.C. §119(a) to Patent Application No. 2011-194430 filed in Japan on Sep. 6, 2011, the entire contents of which are hereby incorporated by reference.

BACKGROUND OF THE INVENTION

1. Field of the Invention

The present invention relates to a fluid control device which performs fluid control.

2. Description of the Related Art

International Publication No. 2008/069264 discloses a conventional fluid pump (see FIGS. 1A to 1E). FIG. 1A to FIG. 1E show operations of the conventional fluid pump in a tertiary mode. The fluid pump, as shown in FIG. 1A, includes a pump body 10; a vibrating plate 20 in which the outer peripheral portion thereof is attached to the pump body 10; a piezoelectric element 23 attached to the central portion of the vibrating plate 20; a first opening 11 formed on a portion of the pump body 10 that faces the approximately central portion of the vibrating plate 20; and a second opening 12 formed on either one of a region intermediate between the central portion and the outer peripheral portion of the vibrating plate 20 or a portion of the pump body 10 that faces the intermediate region.

The vibrating plate 20 is made of metal. The piezoelectric element 23 has a size so as to cover the first opening 11 and a size so as not to reach the second opening 12.

In the above mentioned fluid pump, by applying voltage having a predetermined frequency to the piezoelectric element 23, a portion of the vibrating plate 20 that faces the first opening 11 and a portion of the vibrating plate 20 that faces the second opening 12 are bent and deformed in opposite directions, as shown in FIG. 1A to FIG. 1E. This causes the fluid pump to draw fluid from one of the first opening 11 and the second opening 12 and to discharge the fluid from the other opening.

The above mentioned fluid pump, as is shown in FIG. 1A with a conventional structure, has a simple structure, and thus the thickness of the fluid pump can be made thinner. Such a fluid pump is used, for example, as an air transport pump of a fuel cell system.

At the same time, electronic equipment and apparatuses into which the fluid pump is incorporated have tended to be miniaturized. Therefore, it is necessary to further miniaturize the fluid pump without reducing the pump performance (the discharge flow rate and the discharge pressure) of the fluid pump.

However, the performance of the fluid pump decreases as the fluid pump becomes smaller. Therefore, there are limitations to miniaturizing the fluid pump having the conventional structure while maintaining the pump performance.

Accordingly, the inventors of the present invention have devised a fluid pump having a structure shown in FIG. 2.

FIG. 2 is a sectional view showing a configuration of a main portion of the fluid pump 901. The fluid pump 901 is provided with a base plate 39, a flexible plate 35, a spacer 37, a vibrating plate 31, and a piezoelectric element 32. The fluid pump 901 is provided with a structure in which the above components are layered in that order. The flexible plate 35 corresponds to the "plate" of a preferred embodiment of the present invention.

In the fluid pump 901, the piezoelectric element 32 and the vibrating plate 31 bonded to the piezoelectric element 32 constitute an actuator 30. A ventilation hole 35A is formed in the center of the flexible plate 35. The end of the vibrating plate 31 is fixed to the end of the flexible plate 35 by means of an adhesive via the spacer 37. This means that the vibrating plate 31 is supported at a location spaced away from the flexible plate 35 by the thickness of the spacer 37.

The base plate 39 is bonded to the flexible plate 35. A cylindrical opening 40 is formed in the center of the base plate 39. A portion of the flexible plate 35 is exposed to the side of the base plate 39 through the opening 40 of the base plate 39. The circular exposed portion of the flexible plate 35 can vibrate at a frequency substantially the same as a frequency of the actuator 30 through the pressure fluctuation of fluid accompanied by the vibration of the actuator 30. In other words, through the configuration of the flexible plate 35 and the base plate 39, the portion of the flexible plate 35 that faces the opening 40 serves as a movable portion 41 that is capable of bending and vibrating. Furthermore, a portion on the outside of the movable portion 41 of the flexible plate 35 serves as a fixing portion 42 fixed to the base plate 39.

In the above structure, when driving voltage is applied to the piezoelectric element 32, the vibrating plate 31 bends and vibrates as a result of the expansion and contraction of the piezoelectric element 32. Furthermore, the movable portion 41 of the flexible plate 35 vibrates with vibration of the vibrating plate 31. This causes the fluid pump 901 to suction or discharge air through the ventilation hole 35A. Consequently, since the movable portion 41 vibrates with the vibration of the actuator 30, the amplitude of vibration of the fluid pump 901 is effectively increased. This allows the fluid pump 901 to produce a high discharge pressure and a large discharge flow rate despite the small size and low profile design thereof.

However, with the fluid pump 901, the movable portion 41 of the flexible plate 35 is not supported by the base plate 39. Therefore, the movable portion 41 of the flexible plate 35 bends in a direction away from the vibrating plate 31 through a force such as tension applied to the movable portion 41, thus the distance may increase from the movable portion 41 of the flexible plate 35 to the region of the vibrating plate 31 that faces the movable portion 41.

In this case, it becomes difficult for the vibration of the actuator 30 to be transmitted to the movable portion 41, and the vibration of the movable portion 41 becomes small. Thus, with the fluid pump 901, there is a problem in which the discharge pressure is lower compared to ideal pressure-flow rate characteristics.

Accordingly, by making the distance narrower between the actuator 30 and the flexible plate 35 in advance to allow vibrations by making the thickness of the spacer 37 thinner, it may be possible to increase discharge pressure. However, this method has a problem in which the discharge flow rate will decrease as the discharge pressure increases, and it has been difficult to generate high discharge pressure without decreasing the discharge flow rate.

SUMMARY OF THE INVENTION

In order to resolve the above problems, preferred embodiments of the present invention provide a small and low profile fluid control device capable of obtaining a higher discharge pressure without decreasing a discharge flow rate, compared to conventional rates.

A fluid control device according to a preferred embodiment of the present invention includes a vibrating plate including a first main surface and a second main surface, a driver which is provided on the first main surface of the vibrating plate and vibrates the vibrating plate, and a plate which is arranged so as to face the second main surface of the vibrating plate and has a hole provided on the plate.

At least one of either the vibrating plate or the plate includes a projection projecting in a direction intermediate between the hole and an region of the vibrating plate that faces the hole, the projection is positioned between the hole and the region of the vibrating plate facing the hole.

With this configuration, the distance between the vibrating plate and the plate is less in a portion in which the projection is provided than in other portions on at least one of the vibrating plate and the plate. Therefore, this configuration allows the fluid control device to produce a high discharge pressure.

In addition, with this configuration, at portions in which no projection is provided on at least one of either the vibrating plate or the plate, the distance is not reduced or narrow between the vibrating plate and the plate. For this reason, this configuration prevents the flow rate of fluid, which passes through the vibrating plate and the plate, from decreasing.

Therefore, the fluid control device can attain a high discharge pressure without decreasing the discharge flow rate, as compared with the conventional methods.

Preferably, the fluid control device may further include a base plate which is bonded to the plate and have an opening formed on the base plate, and the plate may include a movable portion facing the opening of the base plate and capable of bending and vibrating as well as a fixing portion that is fixed to the base plate.

With this configuration, the driver vibrates the vibrating plate and the movable portion of the plate vibrates with the vibration of the vibrating plate.

This configuration also includes a first configuration in which the projection is provided on the vibrating plate and a second configuration in which the projection is provided on the plate. In a case of the first configuration, the distance becomes narrower between the movable portion of the plate and the region of the vibrating plate facing the movable portion than between the fixing portion of the plate and the region of the vibrating plate facing the fixing portion of the plate. In a case of the second configuration, the movable portion of the plate is also used as a projection, and thus the distance becomes narrower between the movable portion of the plate and the region of the vibrating plate facing the movable portion than between the base plate and the region of the vibrating plate facing the base plate.

For that reason, with this configuration, even when the movable portion of the plate bends in a direction away from the vibrating plate due to forces such as tension applied to the movable portion, the distance from the movable portion of the plate to the region of the vibrating plate facing the movable portion becomes narrower by an amount equal to the height of the projection. Thus, the vibration of the vibrating plate is more easily transmitted to the movable portion of the plate.

In the case of the first configuration, while the distance is narrower between the movable portion of the plate and the region of the vibrating plate facing the movable portion, the distance is not narrow between the fixing portion of the plate and the region of the vibrating plate facing the fixing portion. Similarly, in the case of the second configuration, while the distance is narrow between the movable portion of the plate and the region of the vibrating plate facing the movable portion, the distance is not narrow between the base plate and the region of the vibrating plate facing the base plate.

Therefore, when the vibrating plate vibrates, the fluid control device can prevent the region of the vibrating plate facing the fixing portion or the base plate from contacting the fixing portion of the plate or the base plate. In other words, the fluid control device can prevent the vibration of the vibrating plate from being restricted by the fixing portion of the plate or the base plate.

Accordingly, in the fluid control device, the movable portion of the plate vibrates fully with the vibration of the vibrating plate. In addition, the fluid control device can prevent the vibration of the vibrating plate from being restricted by the fixing portion of the plate or the base plate. Therefore, the fluid control device can obtain higher pump capabilities.

Preferably, the projection may be provided on the second main surface of the vibrating plate and project towards the movable portion.

With this configuration, a projection is preferably provided in the region of the vibrating plate facing the movable portion. Also, the distance between the movable portion of the plate and the region of the vibrating plate facing the movable portion is narrower than a distance between the fixing portion of the plate and the region of the vibrating plate facing the fixing portion. Thus, the fluid control device obtains a high discharge pressure without decreasing the discharge flow rate, compared to conventional configurations.

Moreover, the projection may preferably be provided as a circular cylinder, for example.

With this configuration, the loss caused by the vibration of the vibrating plate will be reduced. Therefore, the fluid control device enhances operation efficiency as a pump.

The projection may preferably include an end in which the thickness thereof is thinner towards the peripheral edge of the projection.

The shape of the end of the projection in this configuration may be, for example, an R shape or a tapered shape. With this configuration, different pressure distributions can be acquired from the end of the projection and from the central portion of the projection positioned more towards the inside of the end. Therefore, when the fluid is compressed, the fluid will flow more easily from the central portion of the projection having higher fluid pressure in a direction of the end of the projection having lower fluid pressure. Thus, the fluid control device enhances pressure efficiency as a pump.

In addition, with this configuration, even if the surface of the vibrating plate is not uniform, or even if there is a variation in the thickness of the spacer, the fluid control device can prevent the projection from contacting the movable portion.

With this configuration, a portion that requires parallelism between the projection and the movable portion (the portion in which the end of the projection is not provided) is reduced. Therefore, the parallelism of the projection and the movable portion becomes relatively high. Consequently, the fluid control device enhances the compression ratio as a pump.

It is preferable for a region of the whole vibrating plate except for the projection to be made thinner, preferably by etching, than the thickness of the region of the projection of the vibrating plate.

With this configuration, the whole region of the vibrating plate is etched except for the projection, thus, accurately defining the height of the projection by the etching depth.

Therefore, according to this configuration, the fluid control device can attain a high discharge pressure by adjusting the depth of etching, and without decreasing the discharge flow rate, compared to conventional configurations.

In addition, it is preferable for a surface area of the side of the opening of the projection to be greater than the surface area of the opening surface of the opening and to allow the vibration of the vibrating plate to be fully transmitted to the movable portion of the plate.

With this configuration, the projection has a size large enough to cover the movable portion facing the projection. Therefore, the fluid control device can attain a higher discharge pressure.

Moreover, preferably, the fluid control device may further include a vibrating plate unit including the vibrating plate, a frame plate which surrounds the vibrating plate, and a link portion which links the vibrating plate and the frame plate and elastically supports the vibrating plate against the frame plate, and the plate of the fluid control device is bonded to the frame plate so as to face the other main surface of the vibrating plate.

With this configuration, the peripheral portion of the vibrating plate is not substantially fixed. For this reason, with this configuration, the loss caused by the vibration of the vibrating plate will be reduced. Thus, the fluid control device can achieve a higher discharge pressure and a larger discharge flow rate despite the small size and low profile design thereof.

Additionally, it is preferable to adhere the plate to the frame plate with a plurality of particles interposed therebetween, preferably by an adhesive agent containing the plurality of particles.

With this configuration, the distance between the projection and the movable portion of the plate is determined by adjusting the diameter of the plurality of particles. Thus, the distance of the projection and the movable portion of the plate can be determined to ensure that the vibration of the vibrating plate is fully transmitted to the movable portion of the plate.

Additionally, with this configuration, when the frame plate and the plate are fixed preferably by the adhesive agent, the thickness of an adhesive agent layer cannot become thinner than the diameter of each of the particles. Therefore, the fluid control device can reduce the amount of the applied adhesive agent flowing out to the surroundings.

Moreover, with this configuration, the surface at the plate side of the link portion is separated from the plate by at least the diameter of each of the particles. Therefore, even if an excess amount of the adhesive agent flows into a gap between the link portion and the plate, the fluid control device can prevent the link portion from adhering to the plate.

Similarly, with this configuration, the surface at the plate side of the vibrating plate is separated from the plate by least the diameter of each of the particles. Accordingly, even if an excess amount of the adhesive agent flows into a gap between the vibrating plate and the plate, the fluid control device can prevent the vibrating plate from adhering to the plate.

Thus, the fluid control device can prevent the vibrating plate from blocking the vibration of the vibrating plate.

Moreover, it is preferable for the region of the plate facing the link portion to have a hole portion.

With this configuration, when the frame plate and the plate are fixed preferably by an adhesive agent, an excess amount of the adhesive agent flows into the hole portion. Therefore, the fluid control device can further prevent the vibrating plate from adhering to the link portion or adhering to the plate. In other words, the fluid control device can further prevent vibrations of the vibrating plate from being blocked by the adhesive agent.

It is preferable for the vibrating plate and the driver to constitute an actuator and the actuator to be disc shaped.

With this configuration, the actuator vibrates in a rotationally symmetric pattern (a concentric circular pattern). For this reason, an unnecessary gap is not generated between the actuator and the flexible plate. Therefore, the fluid control device enhances the operation efficiency as a pump.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Hereinafter, a piezoelectric pump 101 will be described according to a first preferred embodiment of the present invention.

Figure 1A:
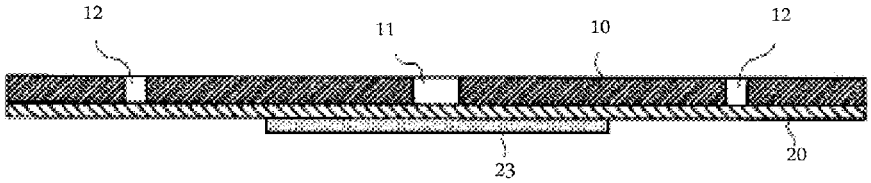
FIG.1A Prior Art
FIG. 1A to FIG. 1E are cross-sectional views of a main portion of a conventional fluid pump.
Figure 1B:
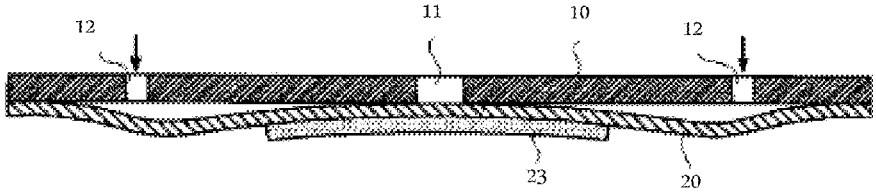
FIG.1B Prior Art
Figure 1C:
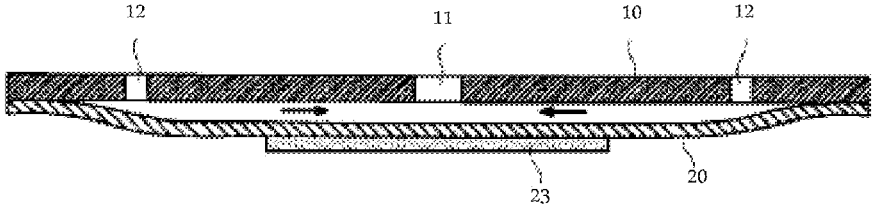
FIG.1C Prior Art
Figure 1D:
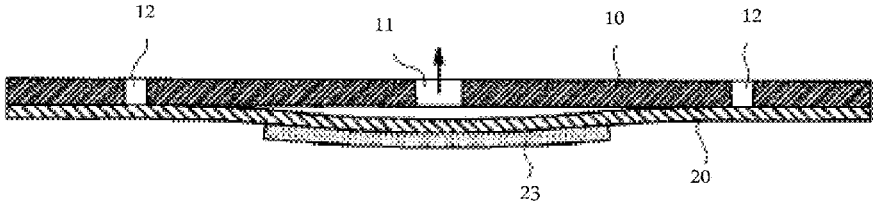
FIG.1D Prior Art
Figure 1E:
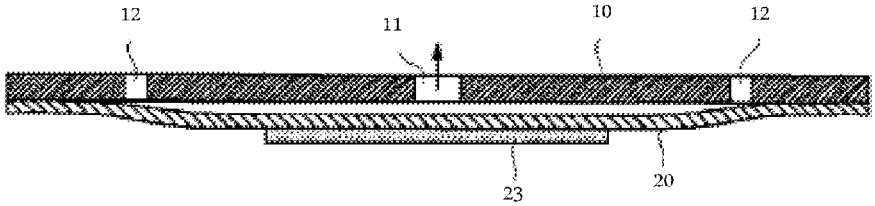
FIG.1E Prior Art
Figure 2:
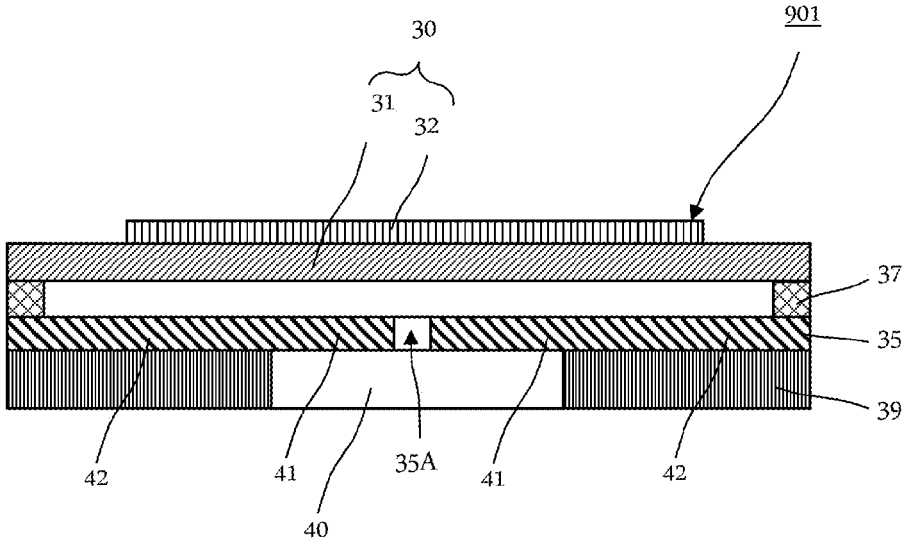
FIG. 2 is a cross-sectional view of a main portion of a fluid pump 901 according to a comparative example of the present invention.
Figure 3:
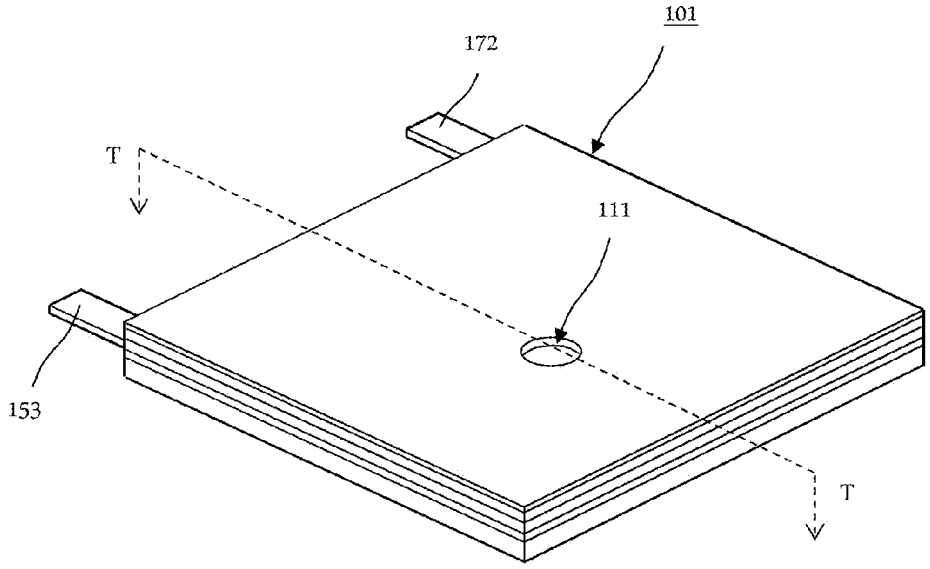
FIG. 3 is an external perspective view of a piezoelectric pump 101 according to a first preferred embodiment of the present invention.
Figure 4:
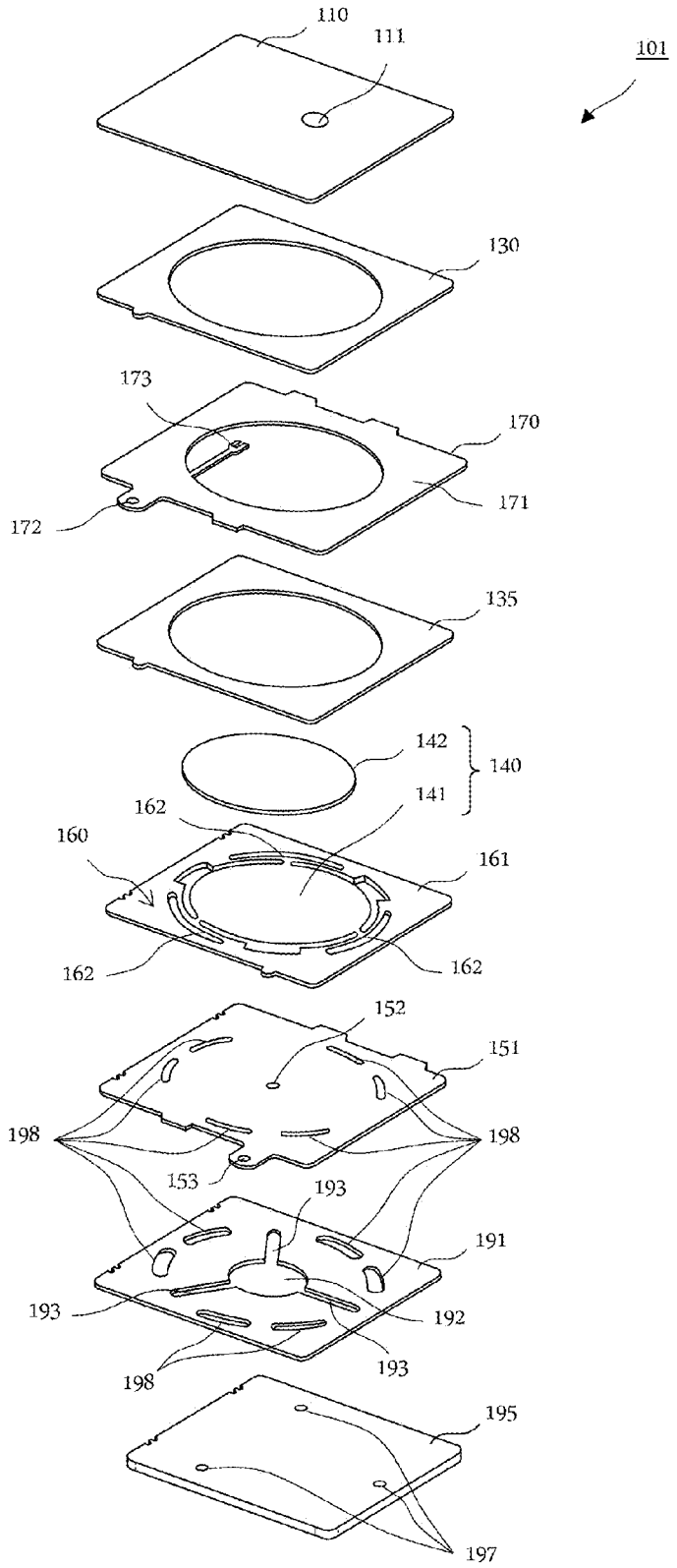
FIG. 4 is an exploded perspective view of the piezoelectric pump 101 as shown in FIG. 3.
Figure 5:
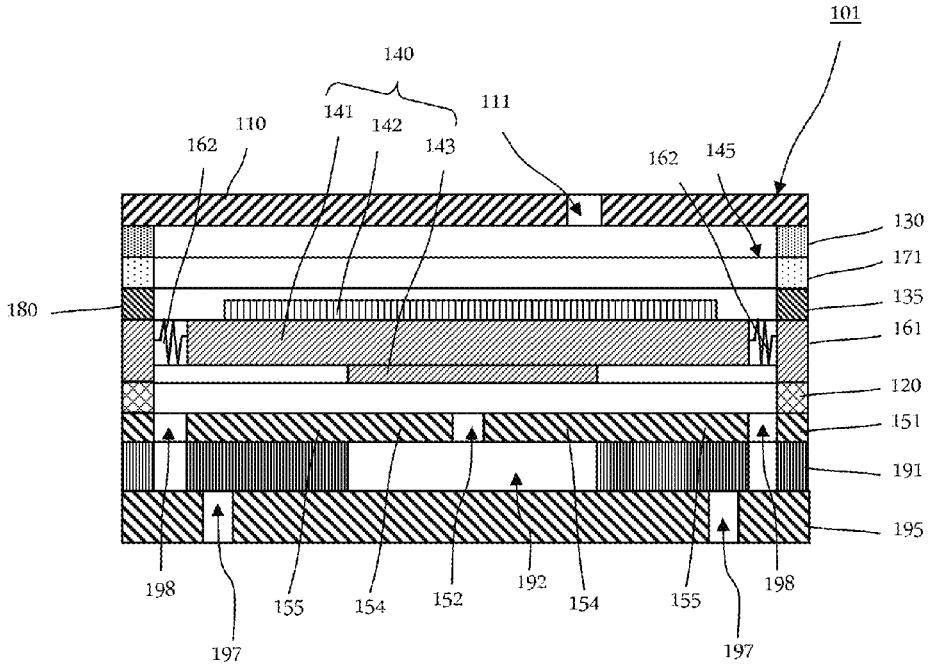
FIG. 5 is a cross-sectional view of the piezoelectric pump 101 as shown in FIG. 3 taken along line T-T.
Figure 6:
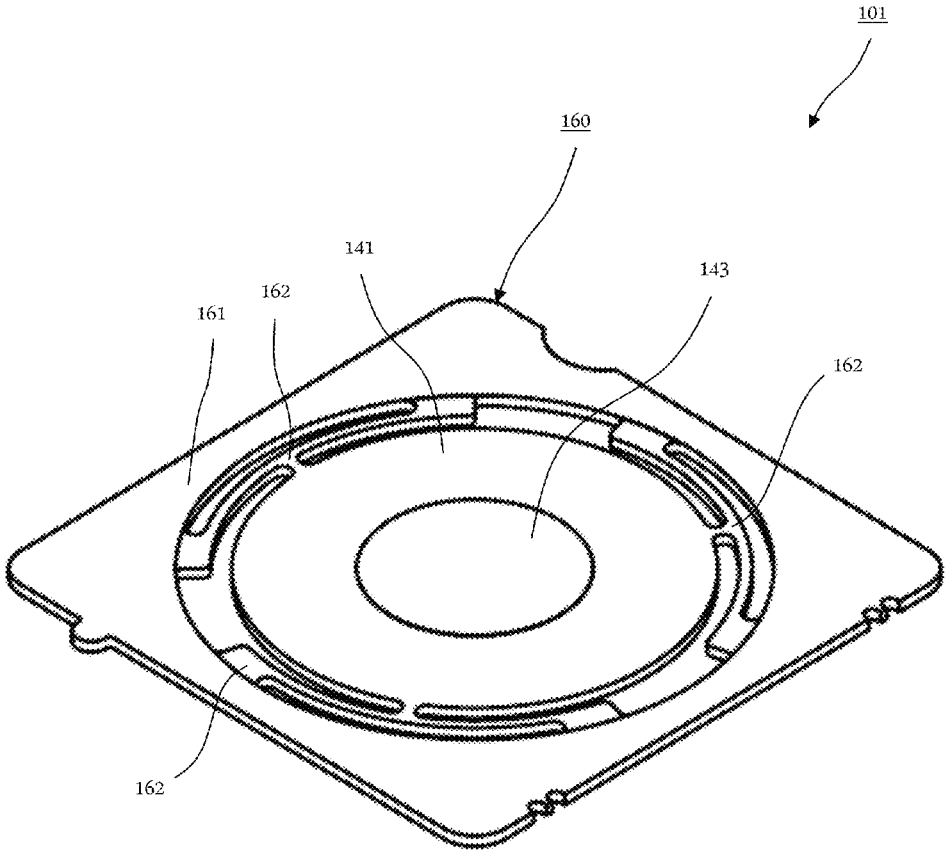
FIG. 6 is an external perspective view of a vibrating plate unit 160 as shown in FIG. 4.
Figure 7:
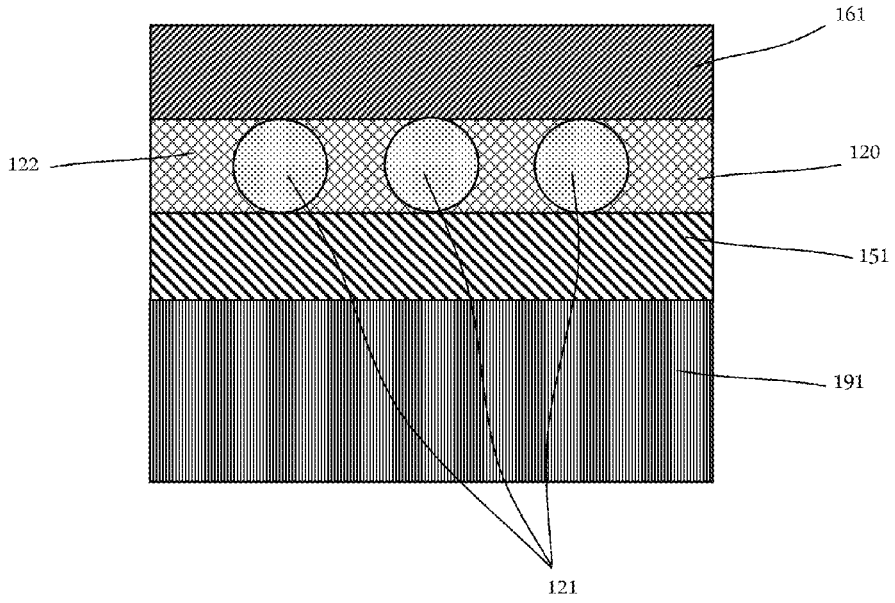
FIG. 7 is a schematic cross-sectional view showing an enlarged adhesive portion of a frame plate 161 and a flexible plate 151 as shown in FIG. 4.

FIG. 3 is an external perspective view of the piezoelectric pump 101 according to the first preferred embodiment of the present invention. FIG. 4 is an exploded perspective view of the piezoelectric pump 101 as shown in FIG. 3. FIG. 5 is a cross-sectional view of the piezoelectric pump 101 as shown in FIG. 3 taken along line T-T. FIG. 6 is an external perspective view of a vibrating plate unit 160 as shown in FIG. 4 as viewed from a flexible plate 151. FIG. 7 is a schematic cross-sectional view showing an enlarged adhesive portion of a frame plate 161 and a flexible plate 151 as shown in FIG. 4.

As shown in FIG. 3 to FIG. 5, the piezoelectric pump 101 preferably includes a cover plate 195, a base plate 191, a flexible plate 151, a vibrating plate unit 160, a piezoelectric element 142, a spacer 135, an electrode conducting plate 170, a spacer 130, and a lid portion 110. The piezoelectric pump 101 is provided with a structure in which the above components are layered in that order.

It is to be noted that the flexible plate 151 is equivalent to the "plate" according to a preferred embodiment of the present invention.

A vibrating plate 141 includes an upper surface facing the lid portion 110, and a lower surface facing the flexible plate 151.

The piezoelectric element 142 is adhesively fixed to the upper surface of the vibrating plate 141. The upper surface of the vibrating plate 141 is equivalent to the "first main surface" according to a preferred embodiment of the present invention. Both the vibrating plate 141 and the piezoelectric element 142 preferably are disc shaped. In addition, the vibrating plate 141 and the piezoelectric element 142 define a disc shaped actuator 140. The vibrating plate unit 160 that includes the vibrating plate 141 is preferably made of a metal material which has a coefficient of linear expansion greater than the coefficient of linear expansion of the piezoelectric element 142. By applying heat to cure the vibrating plate 141 and the piezoelectric element 142 at time of adhesion, an appropriate compressive stress can be left on the piezoelectric element 142 which allows the vibrating plate 141 to bend and form a convex curve on the side of the piezoelectric element 142. This compressive stress can prevent the piezoelectric element 142 from cracking. For example, it is preferred for the vibrating plate unit 160 to be formed of SUS430. For example, the piezoelectric element 142 may be made of lead titanate zirconate-based ceramics. The coefficient of linear expansion for the piezoelectric element 142 is nearly zero, and the coefficient of linear expansion for SUS430 is about $10.4\times 10^{-6}\,K^{-1}$.

It should be noted that the piezoelectric element 142 is equivalent to the "driver" according to a preferred embodiment of the present invention.

The thickness of the spacer 135 may preferably be the same as, or slightly thicker than, the thickness of the piezoelectric element 142.

The vibrating plate unit 160, as shown in FIG. 4 to FIG. 6, preferably includes the vibrating plate 141, the frame plate 161, and a link portion 162. The vibrating plate unit 160 is preferably integrally formed by etching a metal plate. The vibrating plate 141 has the frame plate 161 provided therearound. The vibrating plate 141 is linked to the frame plate 161 by the link portion 162. Furthermore, as shown in FIG. 7, the frame plate 161 is fixed to the flexible plate 151 preferably through an adhesive agent layer 120 which contains a plurality of spherical particles 121.

It should be understood that in order to simplify explanation, only three particles 121 are shown in FIG. 7 although in reality a large number of particles 121 are in existence.

The material for the adhesive agent 122 in the adhesive agent layer 120 may preferably be a thermosetting resin such as an epoxy resin, for example. The material for the particles 121 may preferably be, for example, silica or resin coated with a conductive metal. The adhesive agent layer 120 is cured by heat under pressurized conditions at a time of adhesion. Thus, after the adhesion, the frame plate 161 and the flexible plate 151 are fixed by the adhesive agent layer 120 with the plurality of the particles 121 interposed therebetween.

The vibrating plate 141, as shown in FIG. 5 and FIG. 6, includes a cylindrical projection 143 on the lower surface, with the projection projecting to the side of the flexible plate 151. The lower surface of the vibrating plate 141 is equivalent to the "second main surface" according to a preferred embodiment of the present invention. The projection 143 is disposed in a state of facing the movable portion 154 of the flexible plate 151. The details of the relationship between the vibrating plate 141 and the movable portion 154 of the flexible plate 151 and a fixing portion 155 are described below. The region of the whole of vibrating plate 141 except for the projection 143 and the link portion 162 is preferably thinner than the thickness of the region of the projection 143 of the vibrating plate 141, preferably through half etching the region and the link portion 162.

Therefore, the height of the projection 143 is accurately determined by the depth of the half etching. In this preferred embodiment, the height of the projection 143 preferably is 20 μm, for example. The diameter of the projection 143 preferably is 5.5 mm, for example. In addition, the distance between the region of the vibrating plate 141 facing the fixing portion 155, and the link portion 162 and the flexible plate 151, is accurately determined by the sum (30 μm, for example) of the depth of the half etching and the diameter of each of the particles 121. In other words, the region of the vibrating plate 141 facing the fixing portion 155 and the link portion 162 are disposed separately from the flexible plate 151 with a distance equal to the sum of the depth of the half etching and the diameter of each of the particles 121. The link portion 162 has an elastic structure with an elasticity of a small spring constant.

Therefore, the vibrating plate 141 is flexibly and elastically supported preferably at three points against the frame plate 161 by three link portions 162, for example. For this reason, the bending vibration of the vibrating plate 141 cannot be blocked at all. In other words, the piezoelectric pump 101 has a structure in which the peripheral portion of the actuator 140 (as well as the central part) is not substantially fixed.

It is to be noted that the flexible plate 151, the adhesive agent layer 120, the frame plate 161, the spacer 135, the electrode conducting plate 170, the spacer 130, and the lid portion 110 constitute a pump housing 180. Additionally, the interior space of the pump housing 180 is equivalent to a pump chamber 145.

The spacer 135 is adhesively fixed to an upper surface of the frame plate 161. The spacer 135 is preferably made of resin. The thickness of the spacer 135 is the same as or slightly thicker than the thickness of the piezoelectric element 142. Additionally, the spacer 135 constitutes a portion of the pump housing 180. Moreover the spacer 135 electrically insulates the electrode conducting plate 170, described below, with the vibrating plate unit 160.

The electrode conducting plate 170 is adhesively fixed to an upper surface of the spacer 135. The electrode conducting plate 170 is preferably made of metal. The electrode conducting plate 170 includes a frame portion 171 which is an approximately circular opening, an inner terminal 173 which projects into the opening, and an external terminal 172 which projects to the outside.

The leading edge of the inner terminal 173 is soldered to the surface of the piezoelectric element 142. The vibration of the inner terminal 173 can be significantly reduced and prevented by setting a soldering position to a position equivalent to a node of the bending vibration of the actuator 140.

The spacer 130 is adhesively fixed to an upper surface of the electrode conducting plate 170. The spacer 130 is preferably made of resin. The spacer 130 is a spacer that prevents the soldered portion of the inner terminal 173 from contacting the lid portion 110 when the actuator 140 vibrates. The spacer also prevents the surface of the piezoelectric element 142 from coming too close to the lid portion 110, thus preventing the amplitude of vibration from reducing due to air resistance. For this reason, the thickness of the spacer 130 may be equivalent to the thickness of the piezoelectric element 142.

The lid portion 110 with a discharge hole 111 formed therein is bonded to an upper surface of the spacer 130. The lid portion 110 covers the upper portion of the actuator 140. Therefore, air sucked through a ventilation hole 152, to be described below, of the flexible plate 151 is discharged from the discharge hole 111.

Here, the discharge hole 111 is a discharge hole which releases positive pressure in the pump housing 180 which includes the lid portion 110. Therefore, the discharge hole 111 need not necessarily be provided in the center of lid portion 110.

An external terminal 153 is arranged on the flexible plate 151 to connect electrically. In addition, a ventilation hole 152 is formed in the center of the flexible plate 151. The flexible plate 151 is disposed facing the lower surface of the vibrating plate 141, and is fixed to the frame plate 161 preferably by the adhesive agent layer 120 with the plurality of particles 121 interposed therebetween (see FIG. 7).

On an lower surface of the flexible plate 151, the base plate 191 is attached preferably by the adhesive agent. A cylindrical opening 192 is formed in the center of the base plate 191. A portion of the flexible plate 151 is exposed to the base plate 191 at the opening 192 of the base plate 191. The circularly exposed portion of the flexible plate 151 can vibrate at a frequency substantially the same as a frequency of the actuator 140 through the fluctuation of air pressure accompanying the vibration of the actuator 140. In other words, with the configuration of the flexible plate 151 and the base plate 191, a portion of the flexible plate 151 facing the opening 192 serves as the circular movable portion 154 capable of bending and vibrating. The movable portion 154 corresponds to a portion in the center or near the center of the region facing the actuator 140 of the flexible plate 151. Furthermore, a portion positioned outside the movable portion 154 of the flexible plate 151 serves as the fixing portion 155 that is fixed to the base plate 191. The characteristic frequency of the movable portion 154 preferably is designed to be the same as or slightly lower than the driving frequency of the actuator 140.

Accordingly, in response to the vibration of the actuator 140, the movable portion 154 of the flexible plate 151 also vibrates with large amplitude, centering on the ventilation hole 152. If the vibration phase of the flexible plate 151 is a vibration phase delayed (for example, 90 degrees delayed) from the vibration of the actuator 140, the thickness variation of a gap between the flexible plate 151 and the actuator 140 increases substantially. As a result, the piezoelectric pump 101 improves pump performance (the discharge pressure and the discharge flow rate).

The cover plate 195 is bonded to an lower surface of the base plate 191. Three suction holes 197 are provided in the cover plate 195. The suction holes 197 communicate with the opening 192 through a passage 193 formed in the base plate 191.

The flexible plate 151, the base plate 191, and the cover plate 195 are preferably made of a material having a coefficient of linear expansion greater than a coefficient of linear expansion of the vibrating plate unit 160. In addition, the flexible plate 151, the base plate 191, and the cover plate 195 are preferably made of a material having approximately the same coefficient of linear expansion. For example, it is preferable to have the flexible plate 151 that is made of substances such as beryllium copper. It is preferable to have the base plate 191 that is made of substances such as phosphor bronze. It is preferable to have the cover plate 195 that is made of substances such as copper. These coefficients of linear expansion are approximately $17\times10^{-6}$ $K^{-1}$. Moreover, it is preferable to include the vibrating plate unit 160 that is made of SUS430. The coefficient of linear expansion of SUS430 is about $10.4\times10^{-6}$ $K^{-1}$.

In this case, due to the differences in the coefficients of linear expansion of the flexible plate 151, the base plate 191, and the cover plate 195 in relation to the frame plate 161, by applying heat to cure the flexible plate 151 at time of adhesion, a tension which makes the flexible plate 151 bend and form a convex curve on the side of the piezoelectric element 142, is given to the flexible plate 151. Thus, a tension which makes the movable portion capable of bending and vibrating is adjusted on the movable portion 154. Furthermore, the vibration of the movable portion 154 is not blocked due to any slack on the movable portion 154. It is to be understood that since the beryllium copper which constitutes the flexible plate 151 is a spring material, even if the circular movable portion 154 vibrates with large amplitude, there will be no permanent set-in fatigue or similar symptoms. In other words, beryllium copper has excellent durability.

In the above structure, when a driving voltage is applied to the external terminals 153, 172, the actuator 140 of the piezoelectric pump 101 concentrically bends and vibrates. Furthermore, in the piezoelectric pump 101, the movable portion 154 of the flexible plate 151 vibrates due to the vibration of the vibrating plate 141. Thus, the piezoelectric pump 101 sucks air from the suction hole 197 to the pump chamber 145 through the ventilation hole 152. Then, the piezoelectric pump 101 discharges the air in the pump chamber 145 from the discharge hole 111. In this state of the piezoelectric pump 101, the peripheral portion of the vibrating plate 141 is not substantially fixed. For that reason, the piezoelectric pump 101 achieves significantly reduced loss caused by the vibration of the vibrating plate 141, while being small and low profile, and can obtain a high discharge pressure and a large discharge flow rate.

Figure 8A:
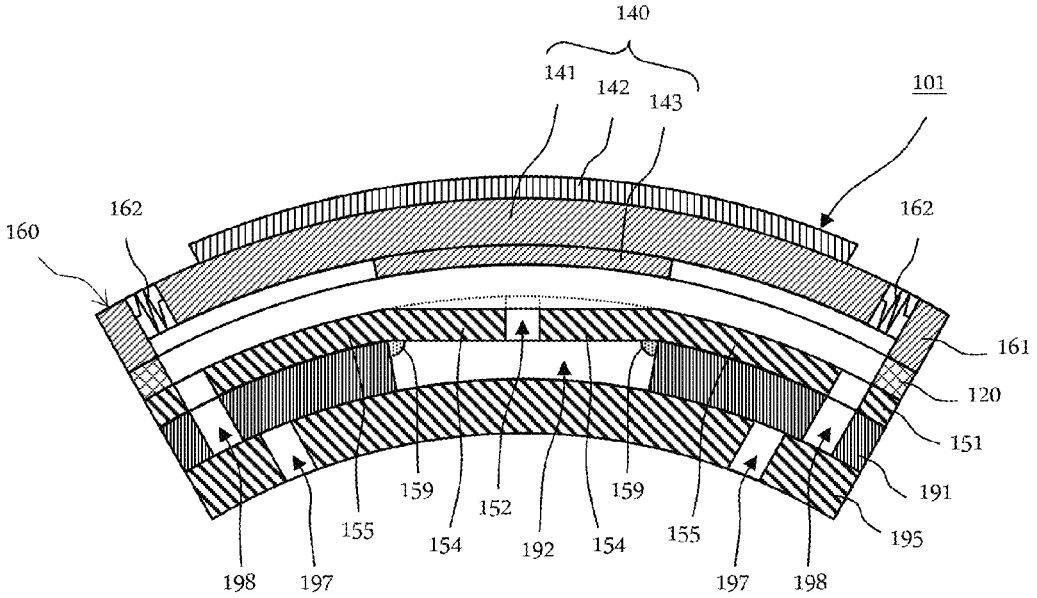
FIG. 8A is a cross-sectional view of the main portion of the piezoelectric pump 101 as shown in FIG. 3 at normal temperature.
Figure 8B:
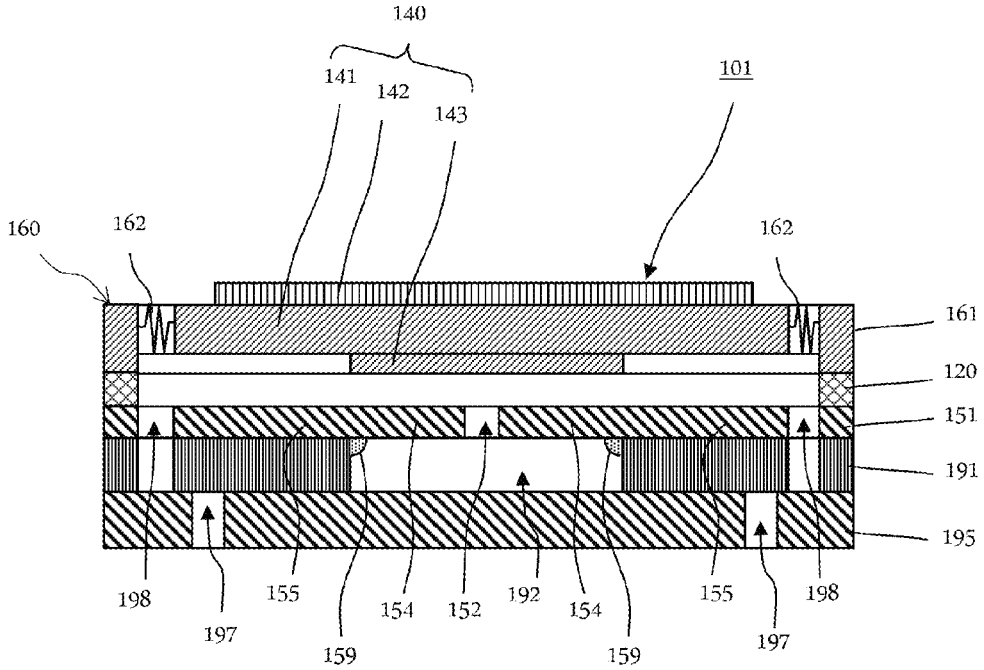
FIG. 8B is a cross-sectional view of the main portion of the piezoelectric pump 101 as shown in FIG. 3 at high temperature.

FIG. 8A is a cross-sectional view of the main portion at normal temperature of the piezoelectric pump 101 as shown in FIG. 3, and FIG. 8B is a cross-sectional view of the main portion at high temperature of the piezoelectric pump 101 as shown in FIG. 3. Here, for illustrative purposes, FIG. 8A highlights the bending of the bonding body of the vibrating plate unit 160, the piezoelectric element 142, the flexible plate 151, the base plate 191, and the cover plate 195 larger than reality. Additionally, in FIGS. 8A and 8B, the lid portion 110, the spacer 130, the electrode conducting plate 170, and the spacer 135 are omitted in the drawing for illustrative purposes.

In the piezoelectric pump 101, the piezoelectric element 142, the vibrating plate unit 160, the flexible plate 151, the base plate 191, and the cover plate 195 are bonded, for example, by an adhesive agent at a temperature (about 120 degrees, for example) higher than a normal temperature (about 20 degrees) (see FIG. 8B). Thus, after the bonding, at the normal temperature, the vibrating plate 141 bends and forms a convex curve on the side of the piezoelectric element 142 due to the difference in the coefficients of linear expansion of the above mentioned vibrating plate unit 160 and the piezoelectric element 142. Furthermore, the flexible plate 151 bends and forms a convex curve on the side of the piezoelectric element 142 due to the difference in the coefficient of linear expansion of the above mentioned vibrating plate unit 160 and the base plate 191 (see FIG. 8A). In the piezoelectric pump 101, at the normal temperature, the vibrating plate 141 and the flexible plate 151 bend and form a convex curve on the side of the piezoelectric element 142 at substantially the same curvature.

However, also in the piezoelectric pump 101, the movable portion 154 of the flexible plate 151 is not supported by the base plate 191. For that reason, at the normal temperature, the movable portion 154 of the flexible plate 151 is bent in a direction away from the vibrating plate 141 by curing contraction of the excess amount 159 of the adhesive agent used when adhered to the flexible plate 151 and the base plate 191 (see FIG. 8A). Accordingly, the distance from the movable portion 154 of the flexible plate 151 to the region of the vibrating plate 141 facing the movable portion 154 becomes longer.

Therefore, in the piezoelectric pump 101, the vibrating plate 141 includes the projection 143 in the region facing the movable portion 154. Thus, the distance between the movable portion 154 of the flexible plate 151 and the region of the vibrating plate 141 facing the movable portion 154 becomes narrower than the distance between the fixing portion 155 of the flexible plate 151 and the region of the vibrating plate 141 facing the fixing portion 155.

Accordingly, even though the movable portion 154 of the flexible plate 151 bends in a direction away from the vibrating plate 141, the distance from the movable portion 154 of the flexible plate 151 to the region of the vibrating plate 141 facing the movable portion 154 becomes narrower by an amount equal to the height of the projection 143. Thus, the vibration of the actuator 140 becomes more easily transmitted to the movable portion 154 of the flexible plate 151. In other words, a high discharge pressure is obtained in piezoelectric pump 101.

Moreover, in the piezoelectric pump 101, while the distance is narrow between the movable portion 154 of the flexible plate 151 and the region of the vibrating plate 141 facing the movable portion 154, the distance is not narrow between the fixing portion 155 of the flexible plate 151 and the region of the vibrating plate 141 facing the fixing portion 155.

Therefore, when the actuator 140 vibrates, since the region of the vibrating plate 141 facing the fixing portion 155 contacts the fixing portion 155 of the flexible plate 151, the vibration of the actuator 140 can be prevented from being restricted by the fixing portion 155 of the flexible plate 151. That is, the distance is not narrow between the fixing portion 155 of the flexible plate 151 and the region of the vibrating plate 141 facing the fixing portion 155, so that the flow rate of the air which passes therebetween is not reduced. In other words, no pressure loss occurs between the fixing portion 155 of the flexible plate 151 and the region of the vibrating plate 141 facing the fixing portion 155.

As mentioned above, the piezoelectric pump 101 can have a high discharge pressure without decreasing discharge flow rate, compared to conventional configurations.

In the piezoelectric pump 101, the movable portion 154 of the flexible plate 151 fully vibrates with the vibration of the vibrating plate 141, and thus the vibration of the vibrating plate 141 can be prevented from being restricted by the fixing portion 155 of the flexible plate 151. Therefore, the piezoelectric pump 101, despite being small and low profile, attains excellent pump capabilities.

In the piezoelectric pump 101, by adjusting the diameter of the plurality of the particles 121, the distance between the projection 143 and the movable portion 154 of the flexible plate 151 can be determined so that vibration of the actuator 140 may be fully transmitted to the movable portion 154 of the flexible plate 151. Additionally, in the piezoelectric pump 101, obtaining a high discharge pressure is easily achieved by adjusting the depth of half etching without decreasing the discharge flow rate, compared to conventional methods.

It is to be noted that the movable portion 154 of the flexible plate 151 bends in a direction away from the vibrating plate 141 (see FIG. 8A). Therefore, it is preferable that the height of the projection 143 is greater than the distance of the leading edge when the movable portion 154 is bent. In addition, it is preferable that the area of the surface on the side of the movable portion 154 of the projection 143 is larger than an area of an opening surface (an upper surface of a cylinder) of the opening 192 so that the vibration of the actuator 140 is fully transmitted to the movable portion 154 of the flexible plate 151. In this case, the projection 143 will have a size large enough to cover the movable portion 154 facing the projection.

In the piezoelectric pump 101, when the frame plate 161 and the flexible plate 151 are fixed through the adhesive agent layer 120, the thickness of the adhesive agent layer 120 does not become thinner than the diameter of each of the particles 121. Therefore, the piezoelectric pump 101 can prevent the adhesive agent 122 of the adhesive agent layer 120 from flowing out to the surroundings.

A surface at the flexible plate 151 side of the link portion 162, in the piezoelectric pump 101, is separated from the flexible plate 151 with a distance equal to the sum of the diameter of each of the particles 121, and the depth of the half etching. Therefore, the piezoelectric pump 101 can prevent the link portion 162 and the flexible plate 151 from adhering to each other even if the excess amount of the adhesive agent 122 flows into a gap between the link portion 162 and the flexible plate 151.

Similarly, in the piezoelectric pump 101, a surface at the side of the flexible plate 151 in the region of the vibrating plate 141 facing the fixing portion 155 is separated from the fixing portion 155 of the flexible plate 151 preferably by a distance equal to the sum of the diameter of each of the particles 121 and the depth of the half etching. Therefore, the piezoelectric pump 101 can prevent the region of the vibrating plate 141 facing the fixing portion 155 and the fixing portion 155 of the flexible plate 151 from adhering to each other even if the excess amount of the adhesive agent 122 flows into a gap between the region of the vibrating plate 141 facing the fixing portion 155 and the fixing portion 155 of the flexible plate 151.

Thus, the piezoelectric pump 101 can prevent the vibrating plate 141 and the link portion 162 and the flexible plate 151 from adhering to each other and blocking the vibration of the vibrating plate 141.

Figure 9:
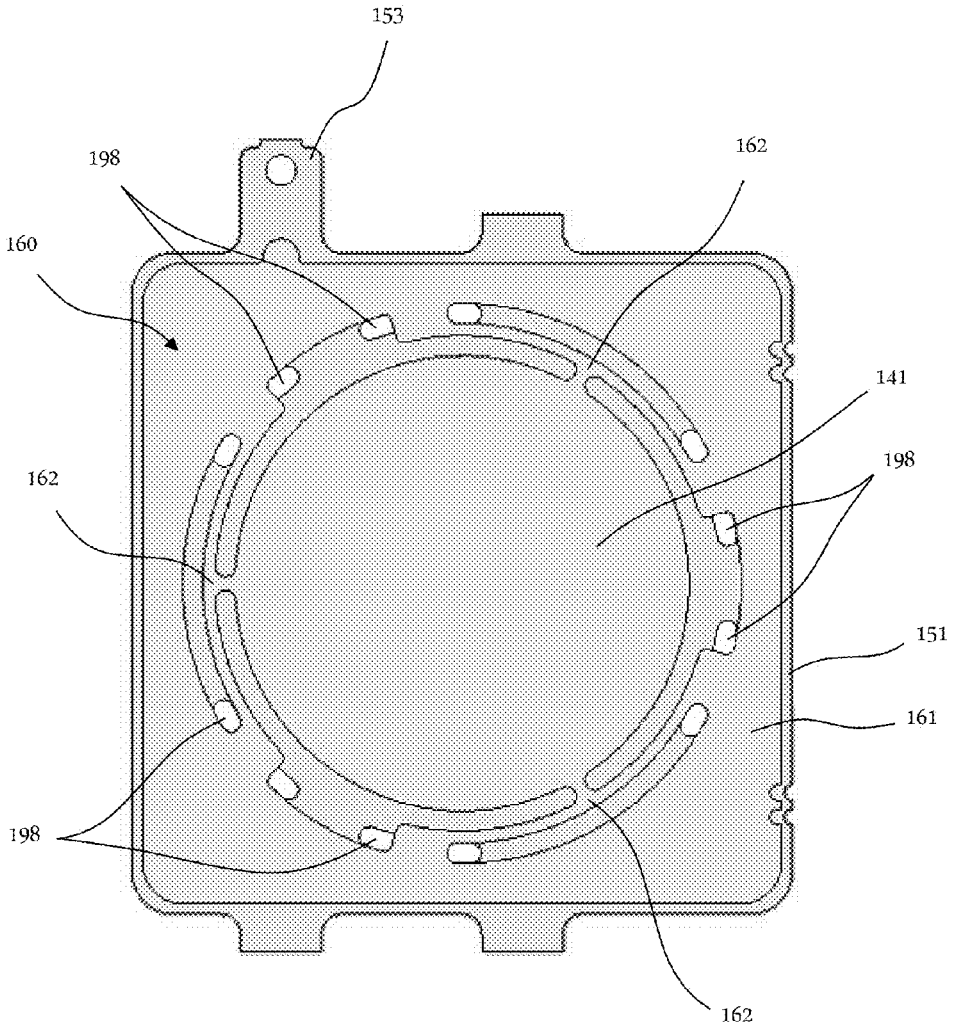
FIG. 9 is a plan view of a bonding body of the vibrating plate unit 160 and the flexible plate 151 as shown in FIG. 4.

FIG. 9 is a plan view of a bonding body of the vibrating plate unit 160 and the flexible plate 151 as shown in FIG. 4.

As shown in FIG. 4 to FIG. 9, it is preferable that a hole portion 198 is provided in the region facing the link portion 162 in the flexible plate 151 and the base plate 191. Thus, when the frame plate 161 and the flexible plate 151 are fixed preferably by the adhesive agent 122, an excess amount of the adhesive agent 122 flows into the hole portion 198.

Therefore, the piezoelectric pump 101 can further prevent the vibrating plate 141 and the link portion 162 and the flexible plate 151 from adhering to each other. In other words, the piezoelectric pump 101 can further prevent the vibration of the vibrating plate 141 from being blocked.

Here, the pressure-flow rate characteristics (the pump capabilities) of the piezoelectric pump 101 according to the present preferred embodiment will be compared with the pressure-flow rate characteristics of a piezoelectric pump in which the projection is removed from the piezoelectric pump 101.

Table 1 represents the results of measurements of discharge flow rates and the discharge pressure of air discharged from the discharge hole 111 of both the piezoelectric pumps under the condition in which the sine wave alternating current voltage of 35 Vp-p of resonance frequency is applied to both piezoelectric pumps.

TABLE 1

| | Discharge Pressure [kPa] | Discharge Flow Rate [L/min] |
|---|---|---|
| Without Projection 35 Vp-p | 0 | 0.269 |
| | 7.7 | 0.202 |
| | 15.3 | 0.136 |
| | 24.2 | 0.061 |
| | 33.1 | 0 |
| With Projection 35 Vp-p | 0 | 0.279 |
| | 8.7 | 0.205 |
| | 18.2 | 0.136 |
| | 29.2 | 0.069 |
| | 44.2 | 0 |

Figure 10:
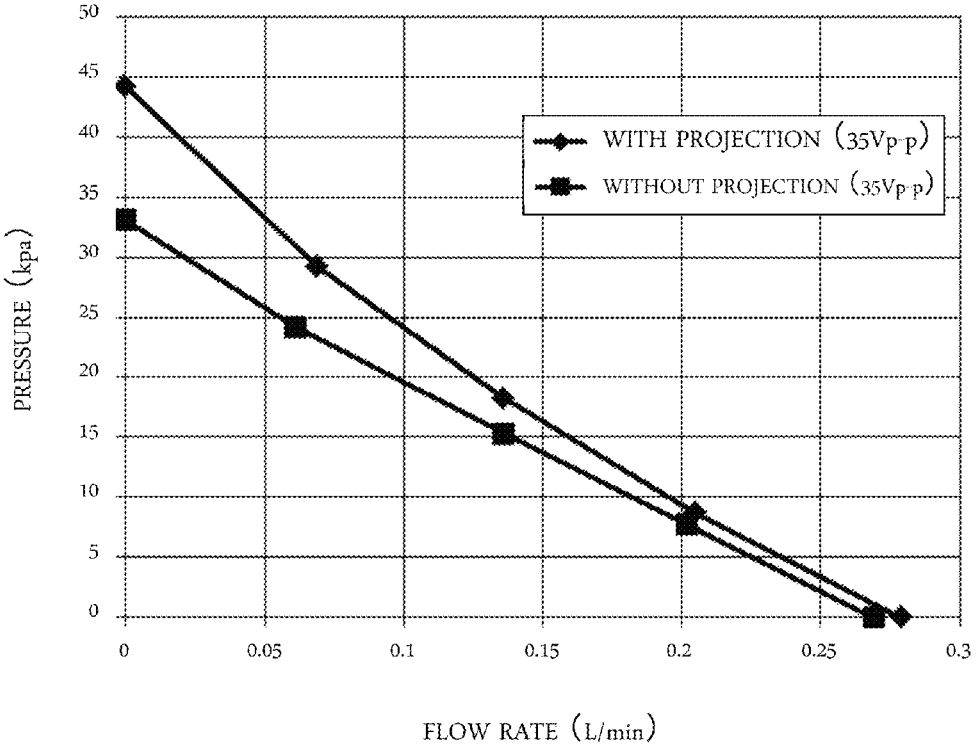
FIG. 10 is a graph which shows pressure-flow rate characteristics of the piezoelectric pump 101 according to the first preferred embodiment of the present invention and pressure-flow rate characteristics of a piezoelectric pump in which a projection 143 is removed from the piezoelectric pump 101.

FIG. 10 is a graph which shows pressure-flow rate characteristics of the piezoelectric pump 101 according to the first preferred embodiment of the present invention and pressure-flow rate characteristics of a piezoelectric pump in which a projection is not provided. Each point of the graph as shown in FIG. 10 corresponds to each of the discharge pressures and each of the discharge flow rates which are shown in Table 1.

It should be noted that as mentioned above, the height of the projection 143 preferably is 20 μm, for example. The diameter of the projection 143 preferably is 5.5 mm, for example.

The result of the measurement as shown in FIG. 10 has revealed that all the discharge flow rates and the discharge pressures of the piezoelectric pump 101 of preferred embodiments of the present invention exceeded the discharge pressure and the discharge flow rate of the piezoelectric pump without the projection. In other words, it became clear that the pump capabilities of the piezoelectric pump 101 provided with the projection 143 was better than the pump capabilities of the piezoelectric pump without the projection. This result indicates a high pressure was obtained by having provided the projection 143 because the distance between the vibrating plate 141 and the flexible plate 151 became narrow in the region of the vibrating plate 141 facing the movable portion 154. In addition, this result indicates the distance between the vibrating plate 141 and the flexible plate 151 did not become narrow in the region of the vibrating plate 141 facing the fixing portion 155, so that the flow rate of air which passes therebetween was not reduced.

Subsequently, the relationship between the discharge pressure of the piezoelectric pump 101 and the diameter of the projection 143 will be described.

Under a condition in which a plurality of piezoelectric pumps 101 were prepared with different diameters of the projection 143, and a sine wave alternating current voltage of 35 Vp-p of the resonance frequency is applied to each of the piezoelectric pumps 101, the result of measurements of the maximum value of the discharge pressure of air discharged from the discharge hole 111 for each of the piezoelectric pumps 101, are shown in Table 2.

TABLE 2

| Diameter of Projection [mm] | Maximum Discharge Pressure [kPa] | Diameter Ratio |
|---|---|---|
| 3.0 | 23.3 | 0.6 |
| 4.5 | 45.0 | 0.9 |
| 5.0 | 51.0 | 1.0 |
| 5.5 | 51.7 | 1.1 |
| 6.5 | 46.3 | 1.3 |
| 8.0 | 37.0 | 1.6 |

Figure 11:
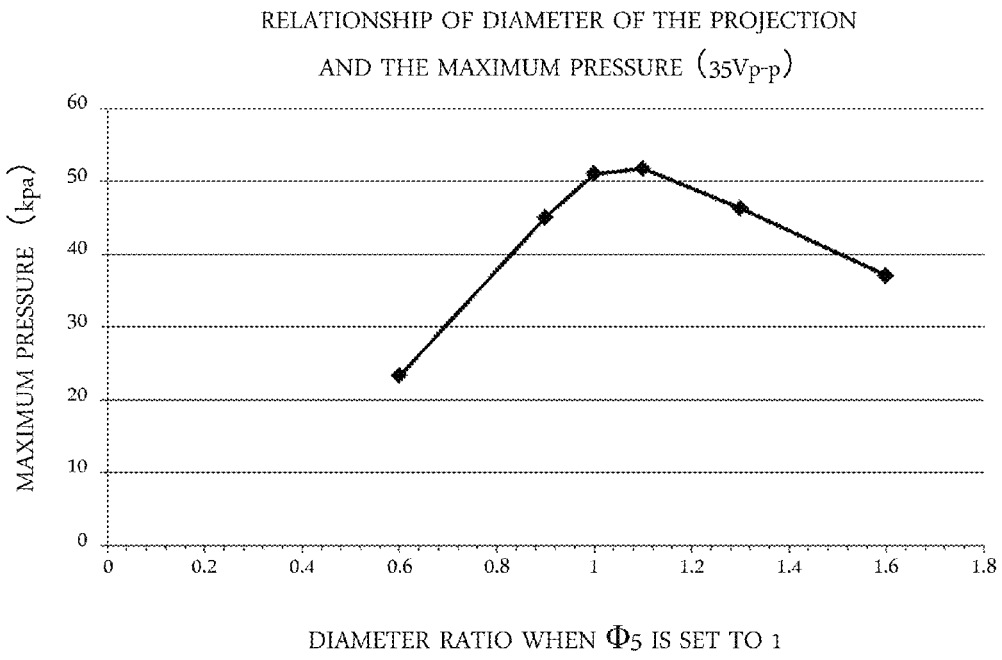
FIG. 11 is a graph which shows a relationship between the maximum pressure force of the piezoelectric pump 101 according to the first preferred embodiment of the present invention and the diameter of the projection 143.

FIG. 11 is a graph which shows the relationship between the maximum pressure force of the piezoelectric pump 101 according to the first preferred embodiment of the present invention and the diameter of the projection 143. Each point of the graph as shown in FIG. 11 corresponds to each maximum pressure force and each diameter ratio which are shown in Table 2.

It should be noted that the diameter of the cylindrical opening 192 preferably is 5 mm, for example. Moreover, the diameter of the projection 143 of each of the piezoelectric pumps 101 is preferably expressed by the diameter ratio when 5 mm is set to 1.

The result of the measurement as shown in FIG. 11 has revealed that the pressure of the piezoelectric pump 101 became lower as the diameter ratio became smaller in the section of "diameter ratio<1". The result indicates that the vibration of the actuator 140 was not fully transmitted to the movable portion 154 of the flexible plate 151, thus the movable portion 154 of the flexible plate 151 did not fully vibrate with the vibration of the vibrating plate 141 because the diameter of the projection 143 was smaller than the diameter of the cylindrical opening 192.

Furthermore, from the result of the measurements as shown in FIG. 11, it became clear that the pressure of the piezoelectric pump 101 became lower as the diameter ratio became larger in the section of "1.18<diameter ratio". The result indicates that when the actuator 140 vibrates, the projection 143 of the vibrating plate 141 contacts the fixing portion 155 of the flexible plate 151, and the vibration of the vibrating plate 141 was restrained by the fixing portion 155 of the flexible plate 151 because the diameter of the projection 143 was larger than the diameter of the cylindrical opening 192.

Also, from the result of the measurements as shown in FIG. 11, it became clear that the pressure of piezoelectric pump 101 became higher in the section of "1.00≤diameter ratio≤1.18", that is, in the section in which the diameter of the projection 143 is from 5 mm to 5.9 mm, for example. The result indicates that the movable portion 154 of the flexible plate 151 is fully vibrated due to the vibration of the vibrating plate 141, and thus the vibration of the vibrating plate 141 was prevented from being restricted by the fixing portion 155 of the flexible plate 151 because the diameter of the projection 143 was the same as, or slightly larger than, the diameter of the cylindrical opening 192.

As mentioned above, in the piezoelectric pump 101, the movable portion 154 of the flexible plate 151 can fully vibrate with the vibration of the vibrating plate 141 by making the diameter of the projection 143 the same as or slightly larger than the cylindrical opening 192. The piezoelectric pump 101 can prevent the vibration of the vibrating plate 141 from being restricted by the fixing portion 155 of the flexible plate 151. In other words, the piezoelectric pump 101, despite being small and low profile, has excellent pump capabilities by making the diameter of the projection 143 the same as, or slightly larger than, the cylindrical opening 192.

Thus, in order to control the discharge pressure and the discharge flow rate of the piezoelectric pump 101, it became clear from the above that it was important to reliably provide an appropriate gap between the vibrating plate 141 and the flexible plate 151. In addition, in order to increase the discharge pressure, it became clear that it is particularly effective to minimize the gap between the surroundings of the ventilation hole 152 provided in the flexible plate 151.

Second Preferred Embodiment

Hereinafter, a piezoelectric pump 201 will be described according to a second preferred embodiment of the present invention.

Figure 12:
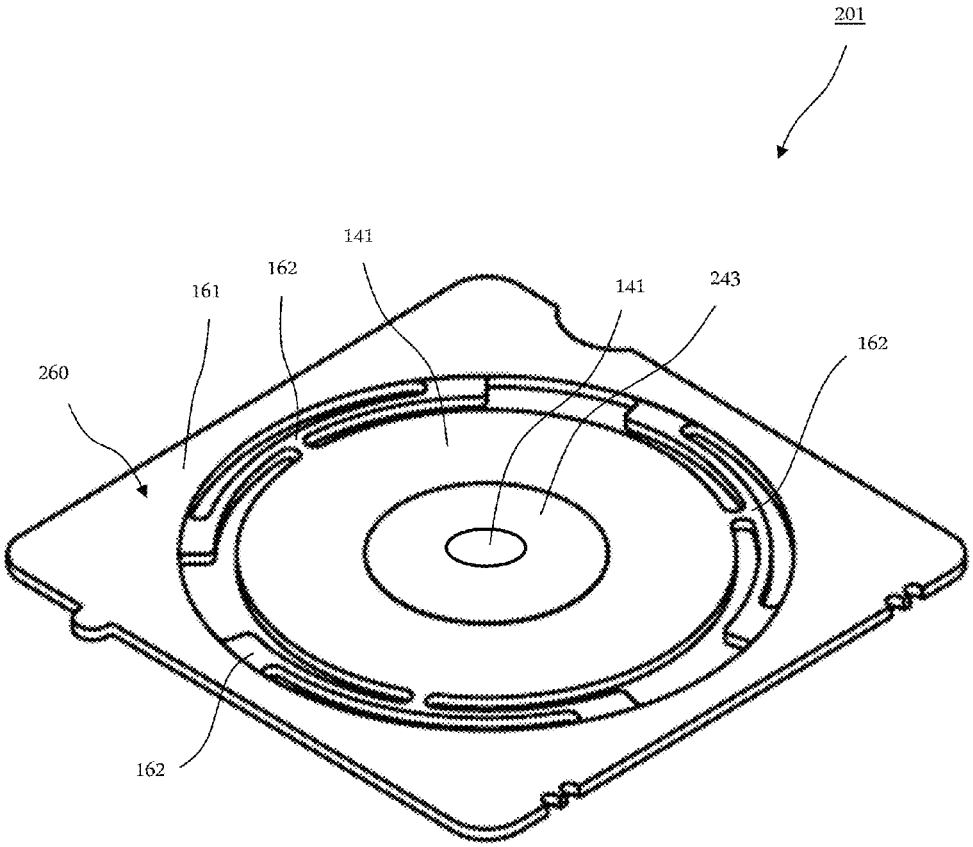
FIG. 12 is an external perspective view of a vibrating plate unit 260 of a piezoelectric pump 201 according to a second preferred embodiment of the present invention.

FIG. 12 is an external perspective view of a vibrating plate unit 260 of the piezoelectric pump 201 according to the second preferred embodiment of the present invention. The piezoelectric pump 201 of the second preferred embodiment is different from the piezoelectric pump 101 of the first preferred embodiment in that a projection 243 preferably has an annular shape. The other configurations are preferably the same as the previous preferred embodiments.

In the piezoelectric pump 201, the distance between the movable portion 154 of the flexible plate 151 and the region of the vibrating plate 141 facing the movable portion 154 also becomes narrower than the distance between the fixing portion 155 of the flexible plate 151 and the region of the vibrating plate 141 facing the fixing portion 155.

Consequently, the piezoelectric pump 201 can achieve the same advantages that the piezoelectric pump 101 according to the first preferred embodiment of the present invention achieved.

Third Preferred Embodiment

Hereinafter, a piezoelectric pump 301 will be described according to a third preferred embodiment of the present invention.

Figure 13:
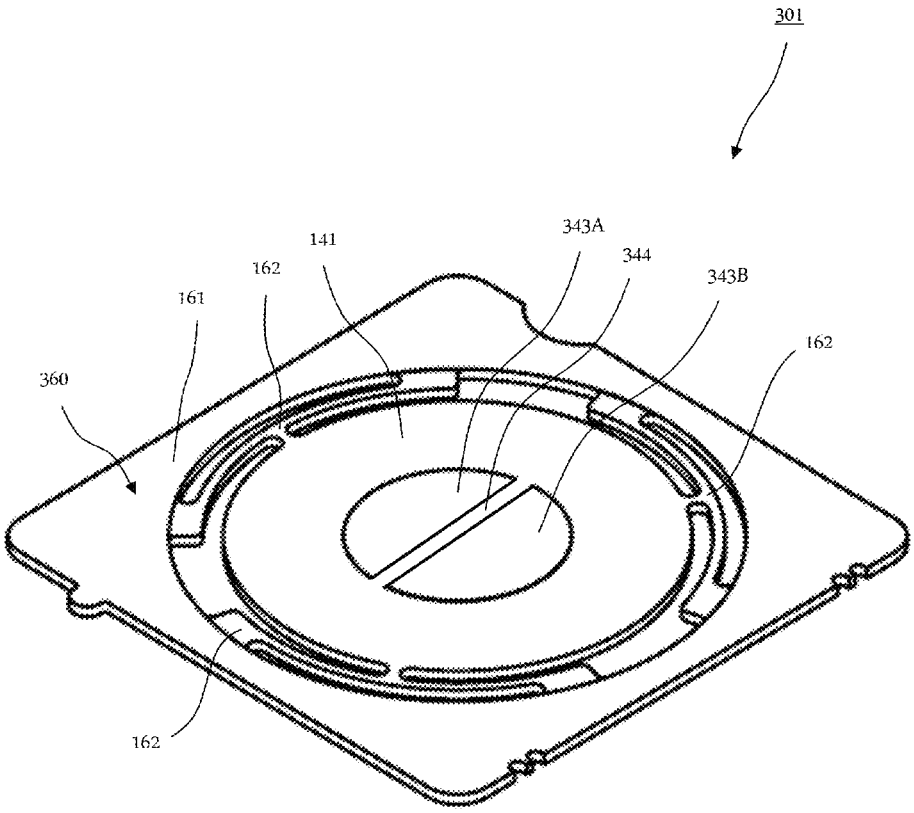
FIG. 13 is an external perspective view of a vibrating plate unit 360 of a piezoelectric pump 301 according to a third preferred embodiment of the present invention.

FIG. 13 is an external perspective view of a vibrating plate unit 360 of the piezoelectric pump 301 according to the third preferred embodiment of the present invention. The piezoelectric pump 301 of the third preferred embodiment is different from the piezoelectric pump 101 of the first preferred embodiment in that the projections 343A and 343B preferably have semicircular shapes. The other configurations are the same as the previous preferred embodiments. Air can pass through a groove 344 between projections 343A and 343B in the piezoelectric pump 301 of this preferred embodiment.

Thus, in the piezoelectric pump 301, the distance between the movable portion 154 of the flexible plate 151 and the region of the vibrating plate 141 facing the movable portion 154 also becomes narrower than the distance between the fixing portion 155 of the flexible plate 151 and the region of the vibrating plate 141 facing the fixing portion 155.

Consequently, the piezoelectric pump 301 can achieve advantages similar to the advantages of the piezoelectric pump 101 according to the first preferred embodiment of the present invention.

Fourth Preferred Embodiment

Hereinafter, a piezoelectric pump 401 will be described according to a fourth preferred embodiment of the present invention.

Figure 14:
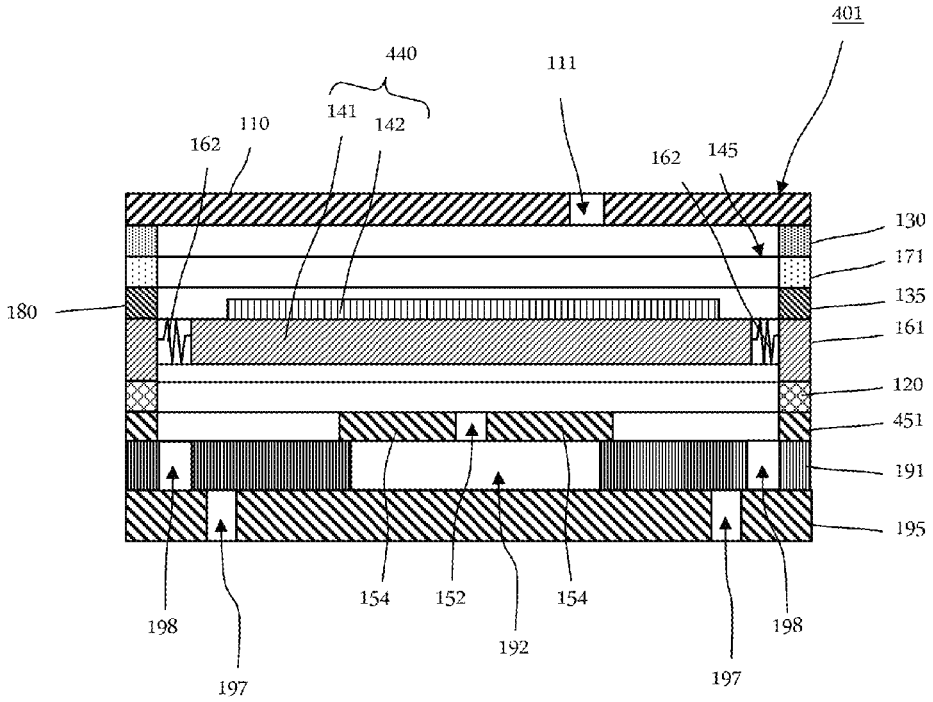
FIG. 14 is a cross-sectional view of a piezoelectric pump 401 according to a fourth preferred embodiment of the present invention.
Figure 15:
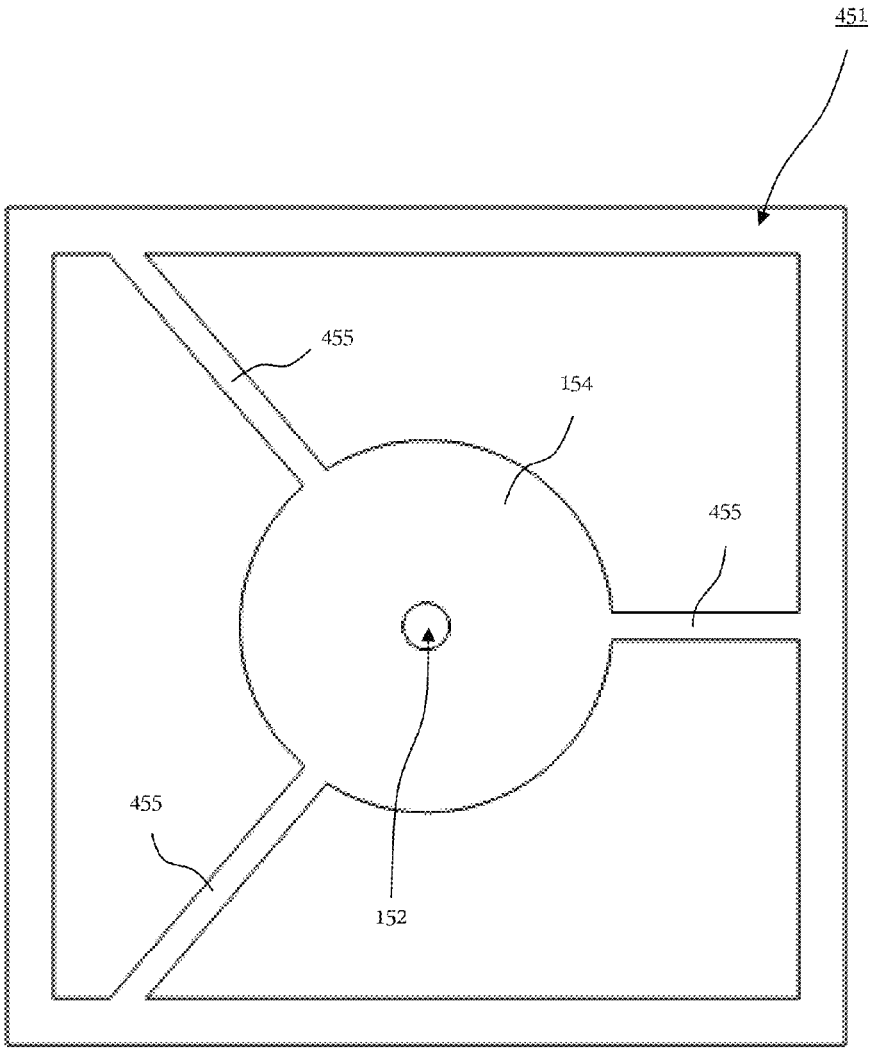
FIG. 15 is a plan view of a flexible plate 451 as shown in FIG. 14.

FIG. 14 is a cross-sectional view of the piezoelectric pump 401 according to the fourth preferred embodiment of the present invention. FIG. 15 is a plan view of a flexible plate 451 as shown in FIG. 14.

The piezoelectric pump 401 of the fourth preferred embodiment and the piezoelectric pump 101 of the first preferred embodiment differ from each other in the shape of the flexible plate 451. The other configurations are preferably the same as the previous preferred embodiments.

In the piezoelectric pump 401, the movable portion 154 of the flexible plate 451 is also preferably used as a projection 154, the distance between the movable portion 154 of the flexible plate 451 and the region of the vibrating plate 141 facing the movable portion 154 becomes narrower than the distance between the base plate 191 and the region of the vibrating plate 141 facing the base plate 191 by a distance equal to the height of the projection 154.

It is to be noted that the region outside the movable portion 154 of the flexible plate 451 serves as a fixing portion 455 fixed to the base plate 191.

In addition, in the piezoelectric pump 401, while the distance is narrow between the movable portion 154 of the flexible plate 451 and the region of the vibrating plate 141 facing the movable portion 154, the distance is not narrow between the base plate 191 and the region of the vibrating plate 141 facing the base plate 191.

Therefore, the piezoelectric pump 401 can obtain a high discharge pressure because the distance between the movable portion 154 of the flexible plate 451 and the region of the vibrating plate 141 that faces the movable portion 154 is narrow. Additionally, since the distance between the base plate 191 and the region of the vibrating plate 141 that faces the base plate 191 is not narrow, the flow rate of air which passes therebetween is not reduced. In other words, pressure loss does not occur.

Therefore, when an actuator 440 vibrates, the region of the vibrating plate 141 facing the base plate 191 can be prevented from contacting the base plate 191. In other words, the vibration of the actuator 440 can be prevented from being restricted by the base plate 191.

Consequently, the piezoelectric pump 401 according to the present preferred embodiment can achieve advantages similar to the advantages of the piezoelectric pump 101 according to the first preferred embodiment of the present invention.

Fifth Preferred Embodiment

Hereinafter, a piezoelectric pump 501 will be described according to a fifth preferred embodiment of the present invention.

Figure 16:
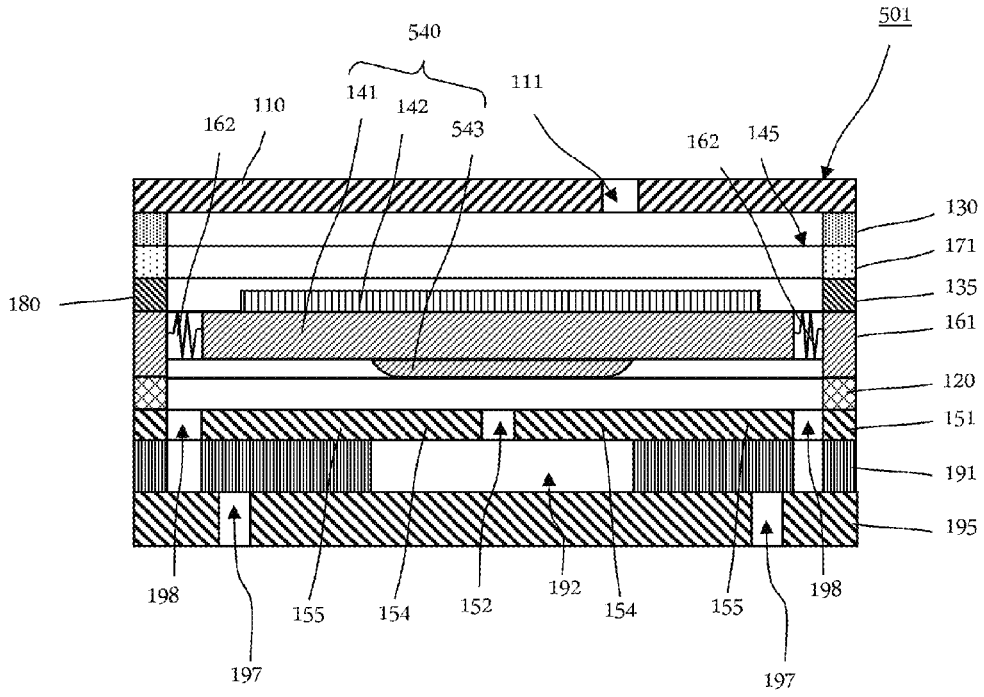
FIG. 16 is a cross-sectional view of a piezoelectric pump 501 according to a fifth preferred embodiment of the present invention.
Figure 17:
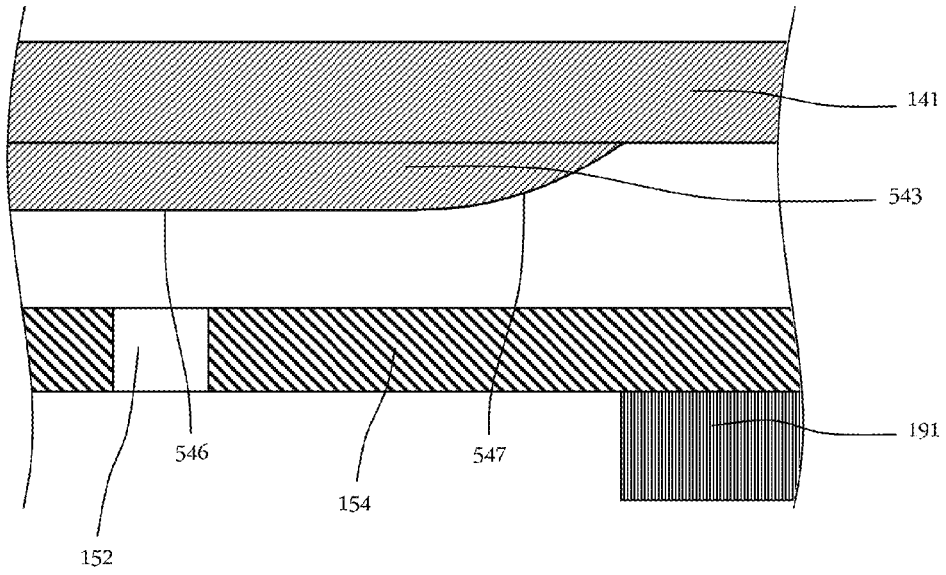
FIG. 17 is a partial enlarged cross-sectional view of a projection 543 as shown in FIG. 16.

FIG. 16 is a cross-sectional view of the piezoelectric pump 501 according to the fifth preferred embodiment of the present invention. FIG. 17 is a partially enlarged cross-sectional view of a projection 543 as shown in FIG. 16. The piezoelectric pump 501 of the fifth preferred embodiment and the piezoelectric pump 101 of the first preferred embodiment differ from each other in the shape of the projection 543. The other configurations are preferably the same as previous preferred embodiments.

The projection 543 preferably includes an R shaped end 547 of which the thickness becomes thinner towards the peripheral edge of the projection 543, and it also includes a flat central portion 546 positioned more inwards than the end 547.

In the piezoelectric pump 501, the distance between the end 547 of the projection 543 and the movable portion 154 of the flexible plate 151 is larger than the distance between the central portion 546 of the projection 543 and the movable portion 154 of the flexible plate 151. Thus, in the piezoelectric pump 501, there will be different pressure distributions in the central portion 546 of the projection 543 and in the end 547 of projection 543, so at time of air compression, air flows more easily from the distance between the central portion 546 of the projection 543 and the movable portion 154 in which air pressure is high to the distance between the distance between the end 547 of the projection 543 and the movable portion 154 in which air pressure is low. Therefore, in the piezoelectric pump 501, the pump pressure efficiency increases.

In addition, in the piezoelectric pump 501 according to the present preferred embodiment, even if the surface of the vibrating plate 141 is not uniformly flat or the thickness varies the adhesive agent layer 120, the projection 543 can be prevented from contacting the movable portion 154.

Moreover, in the piezoelectric pump 501 according to the present preferred embodiment, the portion in which parallelism is required between the projection 543 and the movable portion 154 (the area in which the end 547 of the projection 543 is not provided) will be reduced. For that reason, the parallelism of the projection 543 and the movable portion 154 becomes relatively high. Therefore, in the piezoelectric pump 501, the compression ratio of the pump will increase.

It is to be noted that while the end 547 of the projection 543 preferably has an R shape in this preferred embodiment, it is not limited to this shape. For example, the end 547 of the projection 543 may be formed into shapes such as a tapered shape.

Other Preferred Embodiments

While the actuator 140 preferably having a unimorph type structure and undergoing bending vibration was provided in the above mentioned preferred embodiments, the structure is not limited thereto. For example, it is possible to attach a piezoelectric element 142 on both sides of the vibrating plate 141, so as to have a bimorph type structure and undergo bending vibration.

Moreover, in the above described preferred embodiments, while the actuator 140 which preferably undergoes bending vibration by expansion and contraction of the piezoelectric element 142 was provided, the method is not limited thereto. For example, an actuator which electromagnetically undergoes bending vibration may be provided.

In the above described preferred embodiments, while the piezoelectric element 142 is preferably made of lead titanate zirconate-based ceramics, the material is not limited thereto. For example, an actuator may be made of a piezoelectric material of non-lead based piezoelectric ceramics such as potassium-sodium niobate based or alkali niobate based ceramics.

Additionally, while the above described preferred embodiments showed an example in which the piezoelectric element 142 and the vibrating plate 141 preferably have roughly the same size, there are no limitations to the size. For example, the vibrating plate 141 may be larger than the piezoelectric element 142.

Moreover, although the disc shaped piezoelectric element 142 and the disc shaped vibrating plate 141 were preferably used in the above mentioned preferred embodiments, there are no limitations to the shape. For example, either of the piezoelectric element 142 or the vibrating plate 141 can be a rectangle or a polygon.

In addition, while each of the projections 143, 243, and 343 in the above described preferred embodiments is preferably formed by half etching, there are no limitations to the forming method. For example, each of the projections 143, 243, and 343 may be formed by pressing a metal plate into a metal mold.

Further, while the vibrating plate 141 and each of the projections 143, 243, and 343 are integrally formed in the above described preferred embodiments, there are no limitations to the structure. For example, the vibrating plate 141 and each of the projection 143, 243, and 343 may be formed separately.

Additionally, the shape of a projection is not limited to the shapes of the projections 143, 243, and 343.

Moreover, while a projection is preferably provided in either one of the vibrating plate 141 and the base plate 191 in the above mentioned preferred embodiments, there are no limitations to the number of projections. For example, a projection may be provided in both the vibrating plate 141 and the base plate 191.

Additionally, in the above described preferred embodiments, while the link portion 162 is provided at three spots, the number of places is not limited thereto. For example, the link portion 162 may be provided at only two spots or the link portion 162 may be provided at four or spots. Although the link portion 162 does not block vibration of the actuator 140, the link portion 162 does more or less affect the vibration of the actuator 140. Therefore, the actuator 140 can be held naturally by linking (holding) the actuator at three spots, for example, and the position of the actuator 140 is held accurately. The piezoelectric element 142 can also be prevented from cracking.

In addition, the actuator 140 may be driven in an audible frequency band in a preferred embodiment of the present invention if it is used in an application in which the generation of audible sounds does not cause problems.

Moreover, while the above described preferred embodiments show an example in which one ventilation hole 152 is preferably disposed at the center of a region facing the actuator 140 of the flexible plate 151, there are no limitations to the number of holes. For example, a plurality of holes may be disposed near the center of the region facing the actuator 140.

Further, while the frequency of driving voltage in the above mentioned preferred embodiments is preferably determined so as to make the actuator 140 vibrate in a primary mode, there are no limitations to the mode. For example, the driving voltage frequency may be determined so as to vibrate the actuator 140 in other modes such as a tertiary mode.

In addition, while air is preferably used as fluid in the above mentioned preferred embodiments, the fluid is not limited thereto. For example, any kind of fluid such as liquids, gas-liquid mixture, solid-liquid mixture, and solid-gas mixture can be applied to the above preferred embodiments.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fluid control device comprising:

a vibrating plate including a first main surface and a second main surface;

a driver that is provided on the first main surface of the vibrating plate and vibrates the vibrating plate; and a plate that faces the second main surface of the vibrating plate and includes a hole; wherein the plate includes a movable portion arranged to bend and vibrate; and at least one of either the vibrating plate or the plate includes a projection projecting in a direction between the movable portion and a region of the vibrating plate facing the movable portion.

2. The fluid control device according to claim 1, further comprising a base plate that is bonded to the plate and includes an opening, wherein the plate further includes a fixing portion fixed to the base plate; and the movable portion faces the opening of the base plate.

3. The fluid control device according to claim 1, wherein the projection is arranged on the second main surface of the vibrating plate and projects to the plate.

4. The fluid control device according to claim 1, wherein the projection is a circular cylinder.

5. The fluid control device according to claim 1, wherein the projection includes an end having a thickness that becomes thinner towards a peripheral edge of the projection.

6. The fluid control device according to claim 1, wherein a region of a whole of the vibrating plate except for the projection is thinner than a thickness of a region of the projection of the vibrating plate.

7. The fluid control device according to claim 2, wherein an area of a surface of the projection on a side of the opening is larger than an area of an opening surface of the opening.

8. The fluid control device according to claim 1, further comprising:

a vibrating plate unit including:

the vibrating plate;

a frame plate that surrounds the vibrating plate; and a link portion that links the vibrating plate and the frame plate and elastically supports the vibrating plate against the frame plate; wherein the plate is bonded to the frame plate so as to face the second main surface of the vibrating plate.

9. The fluid control device according to claim 8, wherein the plate is fixed to the frame plate by an adhesive agent containing a plurality of particles, with the plurality of particles interposed between the plate and the frame plate.

10. The fluid control device according to claim 8, wherein the plate comprises a hole portion formed in a region of the plate facing the link portion.

11. The fluid control device according to claim 1, wherein the vibrating plate and the driver constitute an actuator and the actuator is disc shaped.

* * * * *